US006328813B1

(12) United States Patent
Dornier

(10) Patent No.: US 6,328,813 B1
(45) Date of Patent: Dec. 11, 2001

(54) METHOD FOR CONTROLLING AN AUTOMATIC CLEANING DEVICE

(75) Inventor: Iren Dornier, Madrid (DE)

(73) Assignee: Dornier Technologie GmbH & Co. KG, Munich (DE)

( * ) Notice: Subject to any disclaimer, the term of this patent is extended or adjusted under 35 U.S.C. 154(b) by 0 days.

(21) Appl. No.: 09/402,979

(22) PCT Filed: Apr. 3, 1998

(86) PCT No.: PCT/DE98/00957

§ 371 Date: Mar. 10, 2000

§ 102(e) Date: Mar. 10, 2000

(87) PCT Pub. No.: WO98/46111

PCT Pub. Date: Oct. 22, 1998

(30) Foreign Application Priority Data

Apr. 15, 1997 (DE) ..... 197 15 563

(51) Int. Cl.[7] ..... B08B 7/04

(52) U.S. Cl. ..... 134/18; 134/6; 134/57 R; 134/172

(58) Field of Search ..... 134/18, 6, 57 R, 134/172

(56) References Cited

FOREIGN PATENT DOCUMENTS

2435547 * 2/1976 (DE) .
3838299 * 5/1990 (DE) .
29609481 * 11/1996 (DE) .
WO9324044 * 12/1993 (WO) .

* cited by examiner

*Primary Examiner*—Zeinab El-Arini
(74) *Attorney, Agent, or Firm*—Pyle & Piontek

(57) ABSTRACT

According to the method for controlling an automatic cleaning device while a window surface is being cleaned, the cleaning head is first advanced in force-controlled manner approximately centrally or near the edge towards the window surface. This initial position follows from the basic data of the associated building on the basis of the constructional drawing. The cleaning head is then moved in the X- or Z-direction over the window surface up to the window frame in a first edge-search mode and then along the window frame into the associated window corner in which the cleaning process proper starts. The frame of the cleaning head is elastically displaceable relative to the rigid structure so that the control means can sense whether the cleaning head is in contact with a window edge. Alternatively, in the case of frameless windows, there may be provided a sensor whose signal is received by the control means.

9 Claims, 1 Drawing Sheet

METHOD FOR CONTROLLING AN AUTOMATIC CLEANING DEVICE

This is a national stage application of PCT/DE 98/00957 filed Apr. 03, 1998.

BACKGROUND OF THE INVENTION

1. Field of the Invention

The present invention relates to a method for controlling a cleaning head of an automatic cleaning device over window surfaces of a building, the cleaning head being connected to a frame which is movable in the horizontal direction (X-direction) and in the vertical direction (Z-direction) along the facade and is adapted to be positioned in front of a window surface, and the cleaning head being movable relative to the frame towards and away from the window surface to be cleaned (Y-direction) and in the two other directions (X-direction, Z-direction) perpendicular thereto.

2. Description of the Related Art

Automatic cleaning devices have already been suggested that comprise a frame which is suspended on ropes and which the cleaning head is secured to. The frame accommodates the associated units, such as water tanks, power generators, lines, etc.

The frame is suspended with ropes from a crane or a trolley which is movable along rails that are mounted on the roof of the building. The crane moves the frame from window row to window row for carrying out the cleaning operations.

SUMMARY OF THE INVENTION

It is the object of the present invention to provide a method for automatically controlling or driving the cleaning head over the window surfaces to be cleaned.

The control system according to the invention is subdivided into a plurality of control subassemblies which regard the frame, the manipulator holding the cleaning head and the cleaning head itself.

First of all, the basic data of the building to be cleaned are compiled in a table on the basis of the constructional drawing, a division being made into columns and rows. The horizontal rows represent the window position and geometry while the columns indicate the vertical window rows.

These basic data are expediently created with a table calculation program or a data base system.

As described above, the frame of the automatic cleaning device is preferably suspended via ropes from a crane or a trolley and is preferably guided in vertical rails of the building facade, i.e. the frame is positioned in the Z-direction in the respective facade column in front of the individual windows, so that the cleaning operation can be performed there. After the windows of a facade column have been cleaned, the frame is threaded out of the associated vertical guide rails and is displaced in the X-direction in such a manner that the frame can be threaded into the vertical guide rails of the next facade column.

According to the present invention the frame is positioned—on the basis of the facade data which are preferably gathered in a table—in front of a window in such a manner that, when being advanced in the Y-direction, i.e. in the feed movement towards the building, the cleaning head is preferably positioned approximately in the center of the window. This means that the facade data are not critical.

In detail, this is accomplished in that the cleaning head is located in the retracted position whenever the frame is positioned in front of the window in such a manner that the cleaning head can approach approximately the center of the window. The cleaning head is positioned on the surface of the window by activating the Y-axis.

The cleaning head is movable in three directions vertically extending relative to each other. This is accomplished in a preferred embodiment of the invention in that the cleaning head is preferably secured to two adjacently arranged pneumatic piston/cylinder assemblies, with the piston stroke performing the feed movement towards the surface of the window.

The piston/cylinder assemblies, which may be replaced by other suitable drives, are, in turn, secured in a preferred embodiment of the invention to a carriage which is movably arranged on a guide rail extending in the Z-direction.

To be more specific, the configuration may be chosen such that deflection pulleys are respectively positioned at the ends of the guide rails with toothed belts, for example, running over the pulleys and being secured at both sides to the carriage. Said toothed belts are driven by an associated motor.

Furthermore, it is preferred that the guide rail which is designated as the Z-axis in the following and extends in the Z-direction is secured to two carriages that, in turn, are seated on two guide rails extending in the horizontal X-direction, which are hereinafter designated as X-axes. In this case, too, the driving operation is preferably performed via toothed belts which are secured to the carriages and which are running over deflection pulleys and are driven by a separate drive motor for the X-axis.

The drive of the Y-axis is preferably force-controlled. This means that the cleaning head is pressed forwards with a small force after activation of the Y-axis and stops by itself when reaching the window pane.

The return movement into the initial position can e.g. be performed by an elastic force. However, it is preferred that the cleaning head is able to slide back by its own weight into the retracted initial position, to which end the pistons holding the cleaning head extend approximately obliquely upwards.

The Y-position is monitored via a displacement measuring system arranged for said purpose.

After the frame has been moved into approximately the position of the center of the window, the X- and Z-axes travel towards the center of the window in the edge-searching mode, which will be described in more detail further below, and are stopped there. The cleaning head is mounted on the window pane by activation of the Y-axis.

The suction pressure and the rinsing water, which at this time is not used for cleaning the window pane yet, but only serves as a lubricant, are now activated.

According to the invention the cleaning head is now moved preferably in a straight line in the edge-searching mode either in the X-direction or in the Z-direction over the window surface until it reaches an edge of the window, preferably impinging on a window edge. On the assumption that the first motional direction has been in the Z-direction, the cleaning head will now be moved in a window edge-following mode assigned to the Z-direction, preferably an edge-following mode, along the window edge in an edge-searching mode which is operative in the X-direction until the cleaning head impinges on the second window edge, whereby it has reached a corner position of the window. In particular for frameless windows, there may additionally be provided a sensor which senses the arrival at the window edge and supplies a signal to the control means which controls the cleaning head over the window surface.

Preferably, the control means in the edge-searching mode presets a desired speed for the motor assigned to the associated axis, the specific displacement speed depending on the conditions required for the respective window pane and on the distance from the window edge to be expected. In the edge-searching mode only one axis, the X-axis or the Z-axis, is driven at the preset desired speed, whereas the other axis is kept at a fixed position. This may either be done in the edge-following mode, which will be described further below, or in position-controlled fashion.

Furthermore, upon impingement of the cleaning head on a window edge, an element of the cleaning head which comes into contact with the window edge, preferably the frame thereof, is displaced according to the invention relative to the internal rigid structure of the cleaning head, e.g. a brush assembly, the magnitude of said displacement being sensed by a measuring or sensor system, and the measured value which is hereinafter designated as "sensor stroke"0 is supplied to the control means. The frame is here preferably elastically supported relative to the internal rigid structure, e.g. by suitable spring means which are operative between the rectangular frame and the internal rigid structure towards all of the four sides.

It is thereby possible to determine with the sensor stroke assigned to the respective axis whether the cleaning head moves on a free surface, whether it has hit against an obstacle (window edge) or whether it moves along a window edge. The preferably elastically supported element of the cleaning head need not necessarily be the frame thereof, but contact elements which project from the frame could e.g. also be elastically displaceable or deflectable.

As already mentioned above, the drive of the X-axis and the Z-axis is speed-controlled, i.e. the cleaning head is moved on the free surface at a predetermined desired speed over the pane. According to a further proposal of the invention said desired speed of the cleaning head is braked to zero upon impingement on a window edge in response to the displacement of the elastic frame of the cleaning head as sensed by the sensor stroke. It is here preferred that whenever the sensor means of the cleaning head recognizes an impingement on a window edge, the speed preset by the computer is reduced in proportion to the sensor stroke or sensor deflection until standstill of the motion axis. For instance, when a speed of 30% of the maximum value is preset, the drive stops at 30% of the maximum sensor stroke.

It is here within the scope of the present invention that the ratio between the predetermined speed and the sensor stroke may also be disproportionate.

When the cleaning head is moved along a window frame up to the window frame perpendicular thereto, it will automatically follow the window frame in the edge-following mode in which the cleaning head is pressed with a predetermined force against the window frame. This means that during such a movement the cleaning head rests on the frame in such a manner that the elastically supported frame of the cleaning head is deflected by a predetermined value, i.e. a predetermined sensor stroke, from the initial position. This sensor stroke or this elastic displacement of the frame is maintained by the associated drive motor during movement in the direction perpendicular thereto.

Furthermore, upon impingement on a corner of the window, it is intended that the cleaning head is pressed by increasing the sensor stroke in both directions (X-direction and Z-direction) into the corner in such a manner that the brushes of the cleaning head move near the edge of the pane. This is accomplished by increasing the control voltage of both axes. The cleaning operation proper starts from this position in one corner of the window.

After the opposite corner has been reached, with the cleaning head having e.g. followed the vertical edge in the edge-following mode, whereas the drive of the Z-axis was in the edge-searching mode, the Z-axis drive now passes into the edge-following mode while the X-axis is driven such that the cleaning head is moved over a predetermined distance. In a preferred embodiment of the invention this distance may amount to about 90% of the cleaning width of the head. The arrival at the desired position is determined with the aid of a position counter.

The Z-drive is actuated from said position, with the Z-axis being in the edge-searching mode while the X-axis is position-controlled at the same time. This is accomplished with the aid of a position counter which enables the associated computer to compensate a drift. To this end it is suggested that the motor should be provided with a generator which generates a specific number of pulses (e.g 512) per motor revolution. On the basis of these pulses a position counter determines analog values which can rapidly be processed by the computer which will then transmit the corresponding correction signals to the motor. This means that in practice the control unit outputs minute control signals which effect an arrest of the predetermined position of the cleaning head. The fast reaction of the motor is ensured by the combination of the digital with the analog system.

Upon arrival at the opposite window frame the cleaning head is again pressed onto the edge and the X-axis is again displaced by 90% of the head width, whereby the entire window surface is cleaned row by row. Finally, after the whole pane has been cleaned, the cleaning head is lifted off and moved to the next window.

The method of the invention will now be described with reference to a numerical example:

A window having a height of 2 m and a width of 1.50 m is to be cleaned. To this end the cleaning head is placed on the window 0.2 m away from the lower edge and 0.2 m away from the left side edge.

In the edge-searching mode the X-axis is moved at about 50 mm/s. This corresponds to a control voltage of about −1.5 V (minus, since there is movement to the left side).

The Z-axis is held at a position 0.2 m above the lower window edge. If the motor drifts because of the usually existing drift of the controller, such a drift is corrected by the controlling computer and a speed signal is produced in the direction to be corrected. The computer receives the positional information from the position counter.

When the cleaning head impinges on the window edge while moving, the drive is stopped and passes into the edge-following mode. The sensor has moved about 2 mm upon standstill. To secure the position the control voltage of the X-axis is increased to −5 V, so that a sensor position of about 6 mm is set.

The Z-axis now starts in the edge-searching mode. The X-axis is controlled such that the sensor stroke remains constant on the window edge. When the Z-axis also impinges on the window edge, it will stop.

Both axes are now in the edge-following mode. The cleaning head is pushed into the corner of the window by increasing the control voltage on both axes to about −8 V. The stroke of the sensor is about 10 mm in both axes.

The cleaning process proper is now started. The Z-axis is driven at a voltage of about 3 V which makes the cleaning head run upwards at about 100 mm/s. This also means a transition into the edge-searching mode. The X-axis remains in the edge-following mode.

Upon arrival at the upper edge of the window, the Z-axis is again stopped at a sensor stroke of about 3 mm. The cleaning head is pressed into the left upper corner of the window by increasing the control voltage of the Z-axis to 8 V.

The X-axis is now driven and moved by about 90% of the cleaning width of the head. This is accomplished by a control voltage of about +6 V which will be reduced to 0 V when the desired position is reached.

The Z-axis now moves downwards again after a control voltage of about −6 V has been applied. During the downward movement both axes are in the edge-searching mode, the X-axis being positionally controlled at the same time. This is accomplished with the help of the position counter which enables the computer to compensate a possible drift.

When the lower edge of the window has been reached and after pressing the cleaning head thereagainst, the X-axis will again displace the cleaning head by 90% of its head width. An upwardly directed cleaning operation is then again performed. Said operation will be continued until the X-axis, which has constantly been in the edge-searching mode, impinges on the right window edge. In such a case a final vertical cleaning movement is performed with a final pressing of the cleaning head into the right lower corner of the window. It is thereby ensured that the whole pane is cleaned.

Hence, a sensor system which determines whether the cleaning head impinges on an edge of the window is used for controlling the cleaning head. The sensor system determines the displacement of the frame of the cleaning head which is positioned relative to its internal rigid structure in the X- and Z- directions in such a manner that it can be displaced by a certain distance, for instance by about 12 mm. Said distance is sensed by a redundant position measuring system, e.g. a potentiometer, and supplied to the electronic control system. Moreover, a position counting means is used for controlling the head, the position counting means being operative whenever the cleaning head does not move along a window edge.

BRIEF DESCRIPTION OF THE DRAWINGS

An inventive manipulator of an automatic cleaning device for controlling the cleaning head of the device in accordance with the inventive method will now be described in more detail with reference to the drawing, in which.

DETAILED DESCRIPTION

Figure 2:
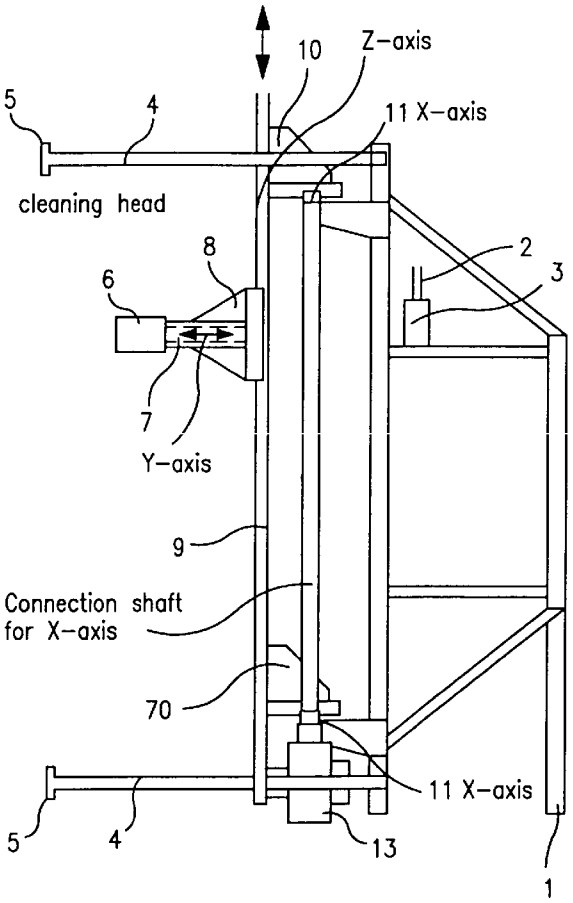
FIG. 2 is a side view of the arrangement according to FIG. 1.

The figures show in a largely schematic manner a frame 1 which is suspended on ropes 2 along a building facade (not shown), the ropes being secured via crane adapters 3 to the frame 1. The frame 1 is provided with an integrated water processing system and a control unit, without said members being shown in the figures.

The frame 1 is provided with rigid support legs 4 whose ends 5 are guided in vertical guide rails (not shown) that are attached to or embedded in the building facade. The invention, however, is not limited to such a type of guidance.

A cleaning head 6 which may e.g. be provided with brushes is secured to one or two piston/cylinder assemblies 7 by which the cleaning head can be moved along the Y-axis (see FIG. 2) into contact with a window pane to be cleaned. The return movement is performed by the cleaning head'own weight or by an otherwise suitable means in the forceless state of the piston/cylinder assembly.

However, the cleaning head 6 may also e.g. be an ultrasonic cleaning head and, instead of a pneumatic piston/cylinder assembly, there may e.g. also be provided a hydraulic assembly or another suitable drive assembly.

Figure 1:
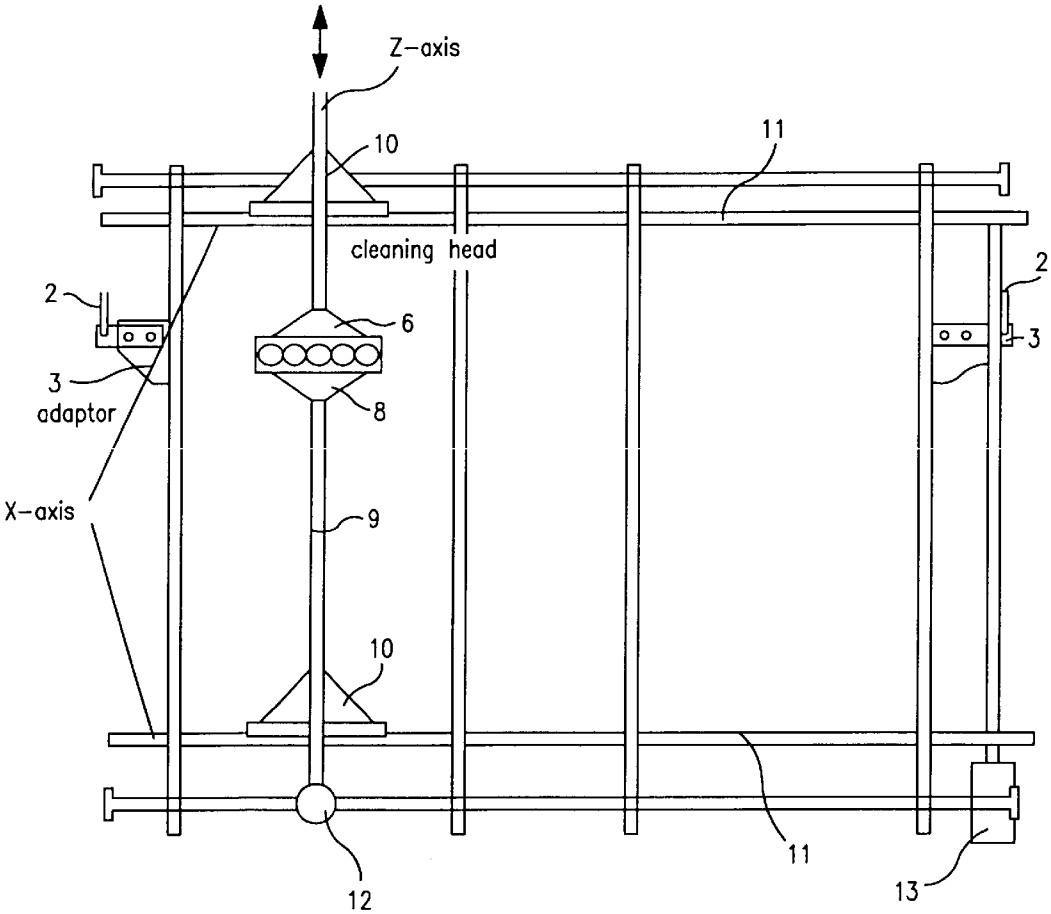
FIG. 1 is a front view of the manipulator.

The cleaning head 6 and its drive means are secured to a carriage 8 which is slidably seated on a guide rail 9 which is designated in FIG. 1 as the Z-axis. The Z-axis 9, in turn, is held by two carriages 10 which, in turn, are slidably seated on two horizontally extending guide rails 11 which are designated in the figures as X-axes.

Deflection pulleys (not shown) over which a respective drive belt is running whose ends are secured to the carriage 8 and the carriages 10, respectively, are positioned at the ends of the guide rails 9 and 11. The belts are driven by a drive motor 12 of the Z-axis and a drive motor 13 of the X-axis, respectively. The cleaning head 6 is thereby moved over a window pane to be cleaned according to the control method of the invention.

What is claimed is:

1. A method for controlling a cleaning head of an automatic window cleaning device wherein a cleaning head is connected to a frame and is moveable with respect to the frame toward and away from the window and also in a horizontal and a vertical direction for cleaning the window, with the window having opposed edges, said method comprising the steps of moving the cleaning head into contact with the window; moving the cleaning head in a first direction across the window until a first window edge is sensed; reversing the direction of the cleaning head in a second direction until the opposite window edge is sensed; and then moving the cleaning head in a third direction perpendicular to the first direction to allow the cleaning head to clean the entire window.

2. The method of claim 1 wherein the window edges are sensed by contact between the cleaning head and the window edge.

3. The method of claim 1 wherein the window edges are sensed by a sensor.

4. The method of claim 1 wherein the cleaning head moves at a given speed, and wherein the speed is adjustable.

5. The method of claim 1 comprising the additional step of elastically displacing the cleaning head upon engagement with the window.

6. The method of claim 1 wherein the cleaning head is stopped upon reaching a window edge.

7. The method of claim 1 wherein the cleaning head exerts a force, and wherein the force against the cleaning head is increased upon reaching a window edge.

8. The method of claim 1 comprising the additional step of, after cleaning of the window, retracting the cleaning head from the window.

9. The method of claim 8 wherein the cleaning head is retracted under the influence of gravity.

* * * * *